US008946572B2

(12) United States Patent
Yang

(10) Patent No.: US 8,946,572 B2
(45) Date of Patent: Feb. 3, 2015

(54) ROTARY SWITCH

(71) Applicant: ScienBiziP Consulting (Shen Zhen) Co, Ltd, Shenzhen (CN)

(72) Inventor: Xin Yang, Shenzhen (CN)

(73) Assignee: ScienBiziP Consulting (Shen Zhen) Co., Ltd., Guangdong (CN)

( * ) Notice: Subject to any disclaimer, the term of this patent is extended or adjusted under 35 U.S.C. 154(b) by 242 days.

(21) Appl. No.: 13/627,963

(22) Filed: Sep. 26, 2012

(65) Prior Publication Data

US 2014/0061012 A1 Mar. 6, 2014

(30) Foreign Application Priority Data

Aug. 28, 2012 (CN) ..... 2012 1 03095998

(51) Int. Cl.
*H01H 19/00* (2006.01)
*H01H 19/11* (2006.01)
*H01H 19/58* (2006.01)

(52) U.S. Cl.
USPC ..... 200/11 R

(58) Field of Classification Search
USPC ..... 200/11 R, 11 TW, 11 J, 14, 564, 568, 336
See application file for complete search history.

(56) References Cited

U.S. PATENT DOCUMENTS

| | | | | |
|---|---|---|---|---|
| 4,490,588 | A * | 12/1984 | Guenther et al. | 200/11 R |
| 7,550,686 | B2 * | 6/2009 | Girke et al. | 200/11 R |
| 7,683,275 | B2 | 3/2010 | Moore et al. | |
| 2014/0209441 | A1 * | 7/2014 | Yang | 200/179 |

FOREIGN PATENT DOCUMENTS

| | | | |
|---|---|---|---|
| CN | 201408676 | Y | 2/2010 |
| CN | 202049888 | U | 11/2011 |

* cited by examiner

*Primary Examiner* — Renee Luebke
*Assistant Examiner* — Lheiren Mae A Caroc
(74) *Attorney, Agent, or Firm* — Novak Druce Connolly Bove + Quigg LLP

(57) ABSTRACT

A rotary switch includes a base forming a number of contacts, a support apparatus installed in the base, and a rotary apparatus rotatably installed in the support apparatus. The support apparatus forms zigzag first and second guiding portions. The rotary apparatus includes a rotary pole, a trigger mounted to the rotary pole, two abutting poles, and two resilient members respectively connected between two opposite ends of the rotary pole and the abutting poles. An end portion of each abutting pole slides along the first guiding portion, to allow the abutting poles to stretch and withdraw along a lengthwise direction of the rotary pole, and allow the abutting poles to undulate along the second guiding portion in a direction perpendicular to the lengthwise direction of the rotary pole, to allow the rotary pole to contact and trigger one of the contacts or pass over the contact.

14 Claims, 8 Drawing Sheets

ROTARY SWITCH

BACKGROUND

1. Technical Field

The present disclosure relates to a rotary switch.

2. Description of Related Art

A rotary switch generally includes a base having a plurality of contacts arranged in an arc-shaped array, and a rotary apparatus rotatably installed to the base. The rotary apparatus includes a contact piece connected to the contacts with friction. However, after the rotary switch has been used for a long time, the contact piece may become worn, resulting in a shortening of the service life of the rotary switch.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The present disclosure, including the accompanying drawings, is illustrated by way of examples and not by way of limitation. It should be noted that references to "an" or "one" embodiment in this disclosure are not necessarily to the same embodiment, and such references mean at least one.

Figure 1:
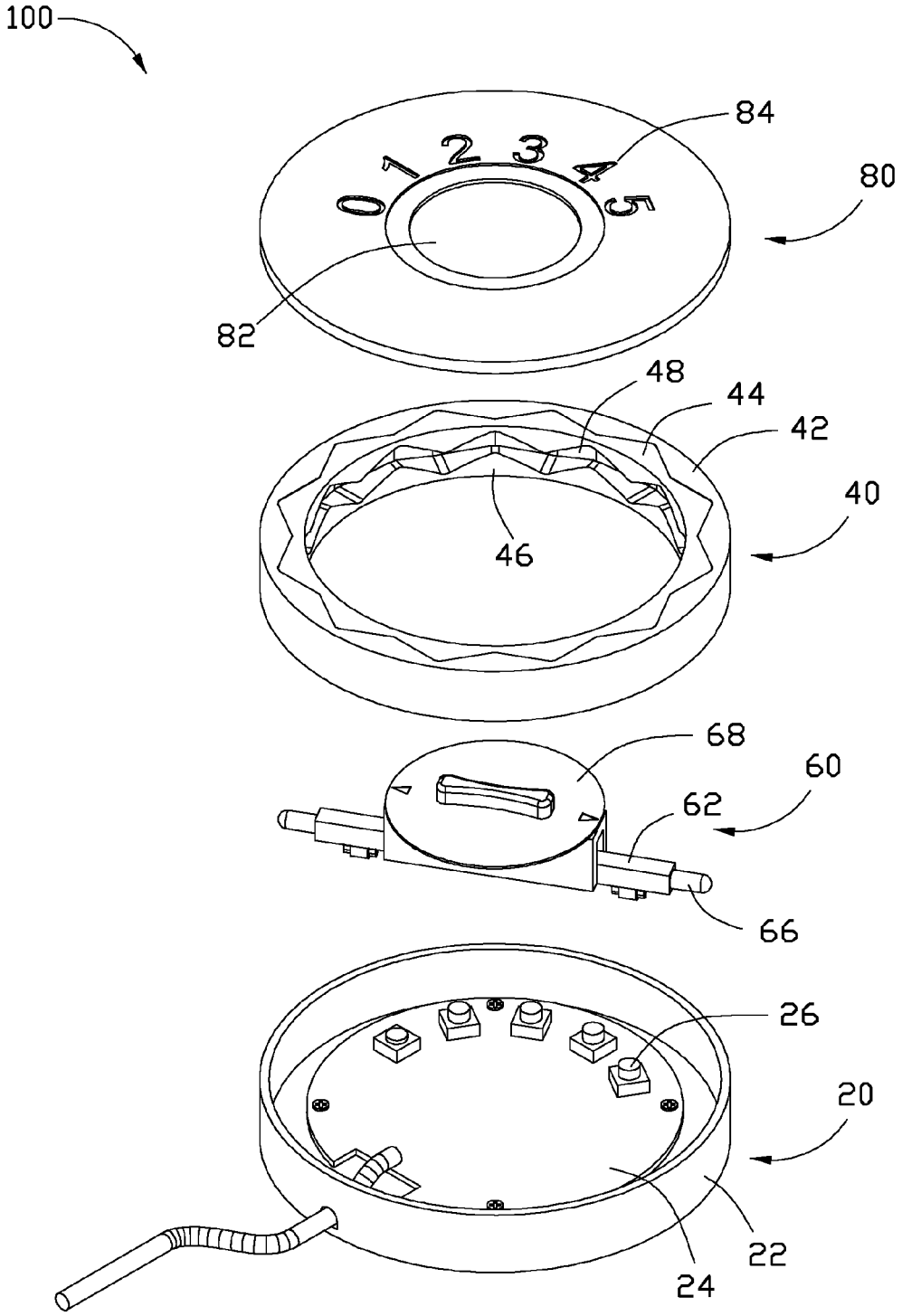
FIG. 1 is an exploded, isometric view of an exemplary embodiment of a rotary switch, wherein the rotary switch includes a support apparatus and a rotary apparatus.

Referring to FIG. 1, an exemplary embodiment of a rotary switch 100 includes a base 20, a support apparatus 40, a rotary apparatus 60, and a cover 80.

The base 20 includes a circular shell 22 and a circular circuit board 24 received in the shell 22. A plurality of resilient contacts 26 is mounted on the circuit board 24, arranged in an arc along a circumference of the circuit board 24.

Figure 2:
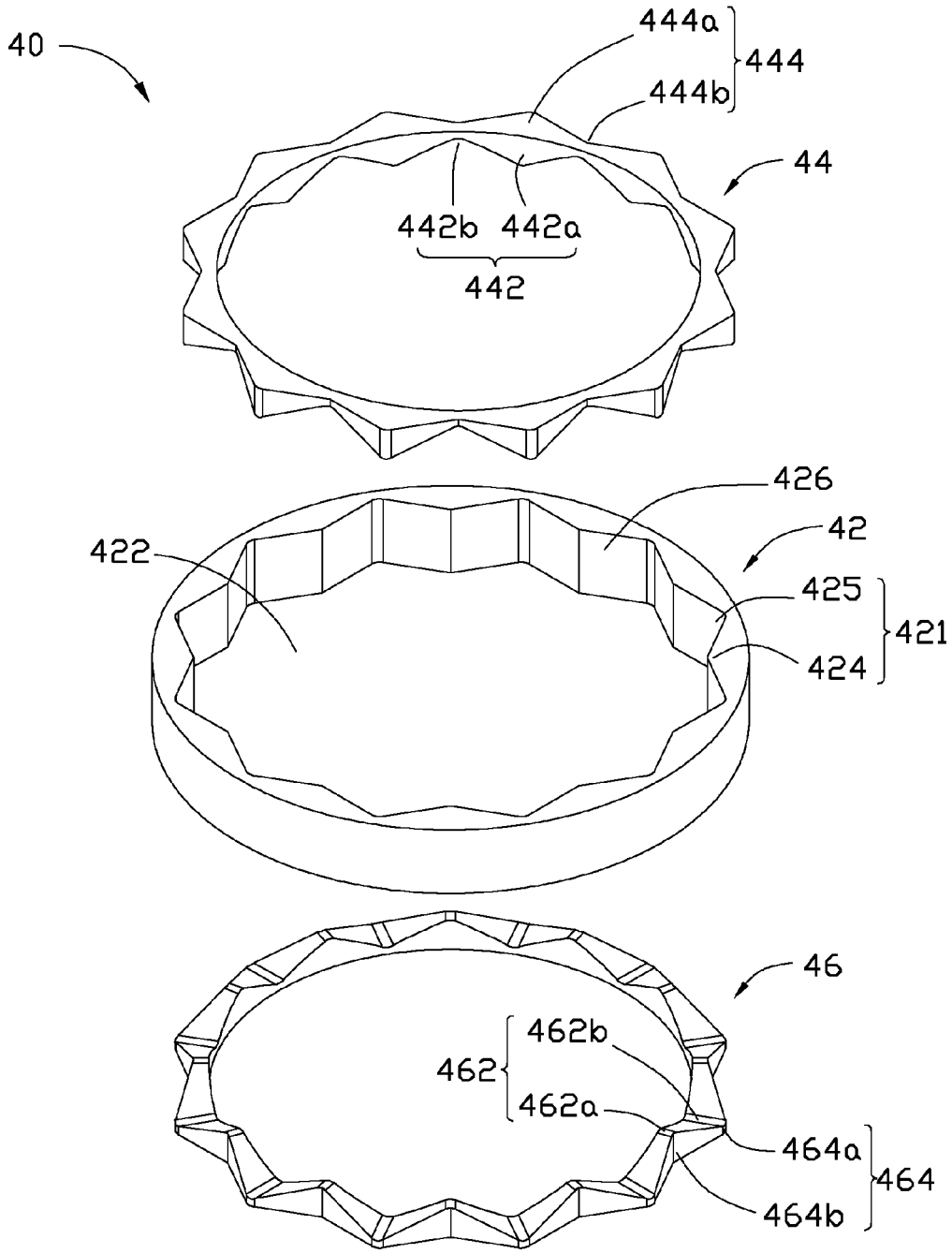
FIG. 2 is an exploded, isometric view of the support apparatus of FIG. 1.

Referring to FIG. 2, the support apparatus 40 includes an annular support member 42, an annular first position member 44, and an annular second position member 46. A center of the support member 42 defines a circular receiving space 422, extending through top and bottom of the support member 42. An inner wall bounding the receiving space 422 of the support member 42 forms a zigzag guiding portion 421 undulating in a radial direction of the support member 42. The guiding portion 421 includes a plurality of triangular protrusions 424 and a plurality of indentations 425 staggered with the protrusions 424. Each protrusion 424 includes two slanted guiding surfaces 426 connected in a line away from the indentations 425.

A bottom surface of the first position member 44 forms a zigzag guiding portion 442 undulating up and down. An outer surface of the first position member 44 forms a zigzag first fastening portion 444 in a radial direction of the first position member 44. The guiding portion 442 includes a plurality of triangular protrusions 442*a*, and a plurality of indentations 442*b* staggered with the protrusions 442*a*. The first fastening portion 444 includes a plurality of triangular protrusions 444*a*, and a plurality of indentations 444*b* staggered with the protrusions 444*a*. The protrusions 442*a* of the guiding portion 442 are respectively corresponding to the protrusions 444*a* of the first fastening portion 444.

A top surface of the second position member 46 forms a zigzag guiding portion 462 undulating up and down. An outer surface of the second position member 46 forms a zigzag second fastening portion 464 undulating in a radial direction of the second position member 46. The guiding portion 462 includes a plurality of triangular protrusions 462*a*, and a plurality of indentations 462*b* staggered with the protrusions 462*a*. The second fastening portion 464 includes a plurality of triangular protrusions 464*a*, and a plurality of indentations 464*b* staggered with the protrusions 464*a*. The protrusions 462*a* of the guiding portion 462 are respectively corresponding to the indentations 464*b* of the second fastening portion 464.

The second position member 46 is received in a lower portion of the receiving space 422. The protrusions 464*a* of the second fastening portion 464 are respectively latched in the indentations 425 of the support member 42. The protrusions 462*a* of the guiding portion 462 are respectively located at inner sides of the protrusions 424 of the support member 42, and the indentations 462*b* of the guiding portion 462 are respectively located at inner sides of the indentations 425 of the support member 42.

The first position member 44 is received in an upper portion of the receiving space 422, and is spaced from the second position member 46. The protrusions 444*a* of the first fastening portion 444 are respectively latched in the indentations 425 of the support member 42. The protrusions 442*a* of the guiding portion 442 are respectively located at inner sides of the indentations 425 of the support member 42, and are aligned with the indentations 462*b* of the guiding portion 462. The indentations 442*b* are respectively located at the inner sides of the protrusions 424 of the support member 42, and the protrusions 442*a* are respectively located at the inner sides of the indentations 425. The guiding portion 442 of the first position member 44 and the guiding portion 462 of the second position member 46 cooperatively bound a zigzag guiding slot 48 undulating up and down, and also undulating in a radial direction of the support member 42.

Figure 3:
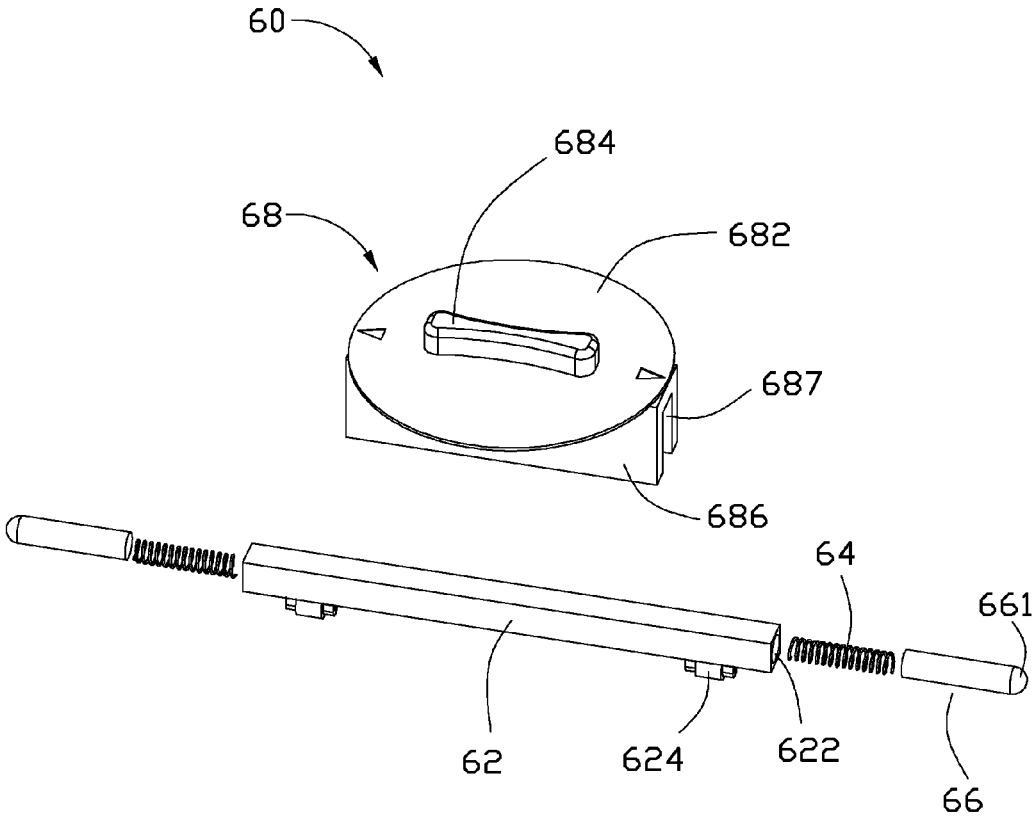
FIG. 3 is an exploded, isometric view of the rotary apparatus of FIG. 1.

Referring to FIG. 3, the rotary apparatus 60 includes a rotary pole 62, two resilient members 64, two cylindrical abutting poles 66, and an operation member 68. Two opposite ends of the rotary pole 62 each longitudinally define a locating hole 622. Two triggers 624 extend down to two ends of a bottom of the rotary pole 62. A first end of each abutting pole 66 forms a hemispherical end portion 661. The operation member 68 includes a circular rotary plate 682, a handle 684 protruding up from a middle of the rotary plate 682, and a guiding block 686 extending down from the middle of the rotary plate 682 opposite to the handle 684. A bottom of the guiding block 686 defines a slot 687. In the embodiment, each resilient member 64 is a coil spring.

The cover 80 is a circular plate. A middle of the cover 80 defines a circular opening 82 for receiving the rotary plate 682 of the operation member 68. A plurality of labels 84 is formed on a top of the cover 80, arranged in an arc along the opening 82.

Figure 4:
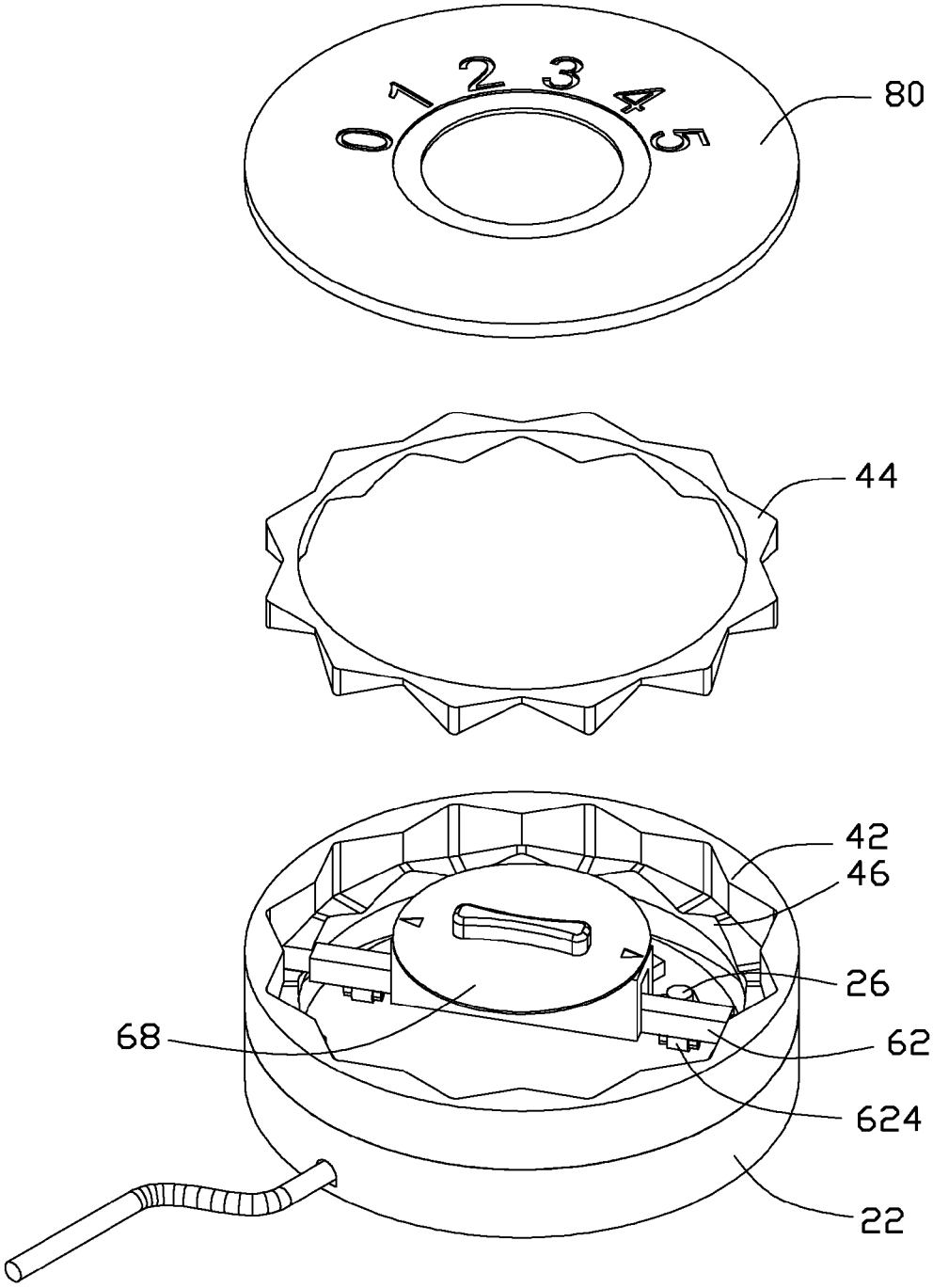
FIG. 4 is a partially assembled, isometric view of FIG. 1.
Figure 5:
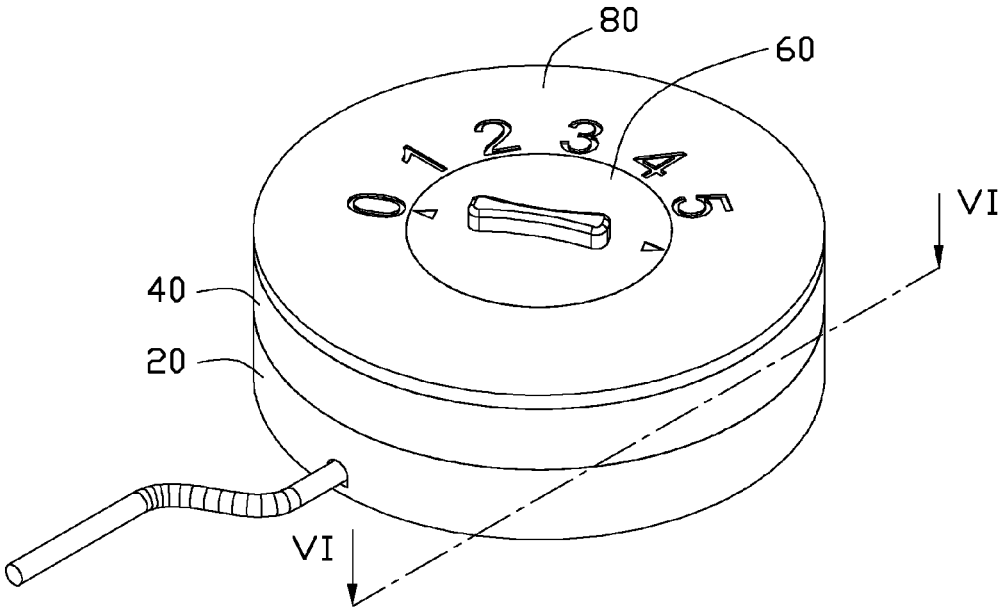
FIG. 5 is an assembled, isometric view of FIG. 1.

Referring to FIG. 4 and FIG. 5, in assembly, the resilient members 64 are respectively received in the locating holes 622. Second ends of the abutting poles 66 opposite to the end portions 661 are respectively inserted into the locating holes 622. A combination of the rotary pole 62, the resilient members 64, and the abutting poles 66 is rotatably received in the receiving space 422 of the support apparatus 40. The abutting poles 66 are slidably received in the guiding slot 48 between the first position member 44 and the second position member 46. The end portions 661 of the abutting poles 66 are respectively received in two opposite indentations 425, and resiliently abut against the support member 42. The guiding block 686 of the operation member 68 is received in the receiving space 422. A middle of the rotary pole 62 is slidably received in the slot 687. The support member 42 is mounted in the base 20 by screwing or clamping. The contacts 26 are respectively received in the corresponding indentations 425 of the support member 42. The cover 80 is fixed on a top of the support member 42 by screwing or clamping. The rotary plate 682 is received in the opening 82. The labels 84 respectively align with the contacts 26.

Figure 6:
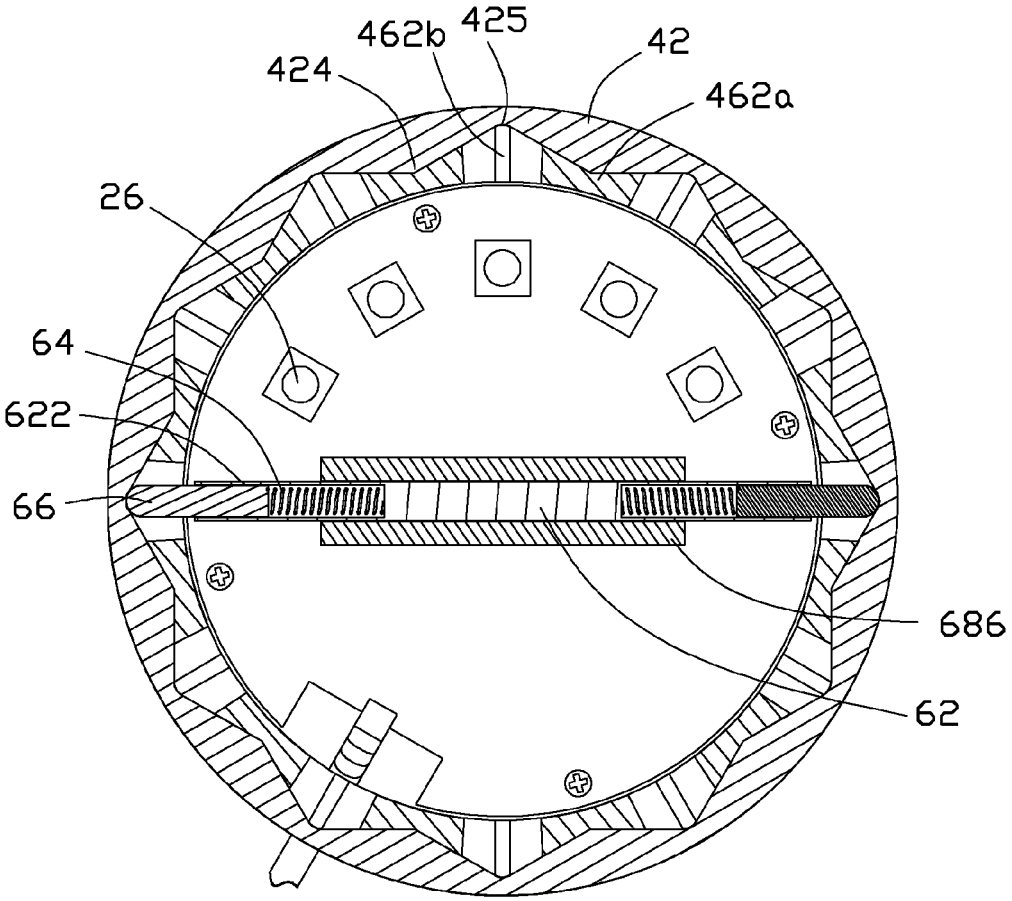
FIG. 6 is a cross-sectional view of FIG. 5, taken along the line of VI-VI.
Figure 7:
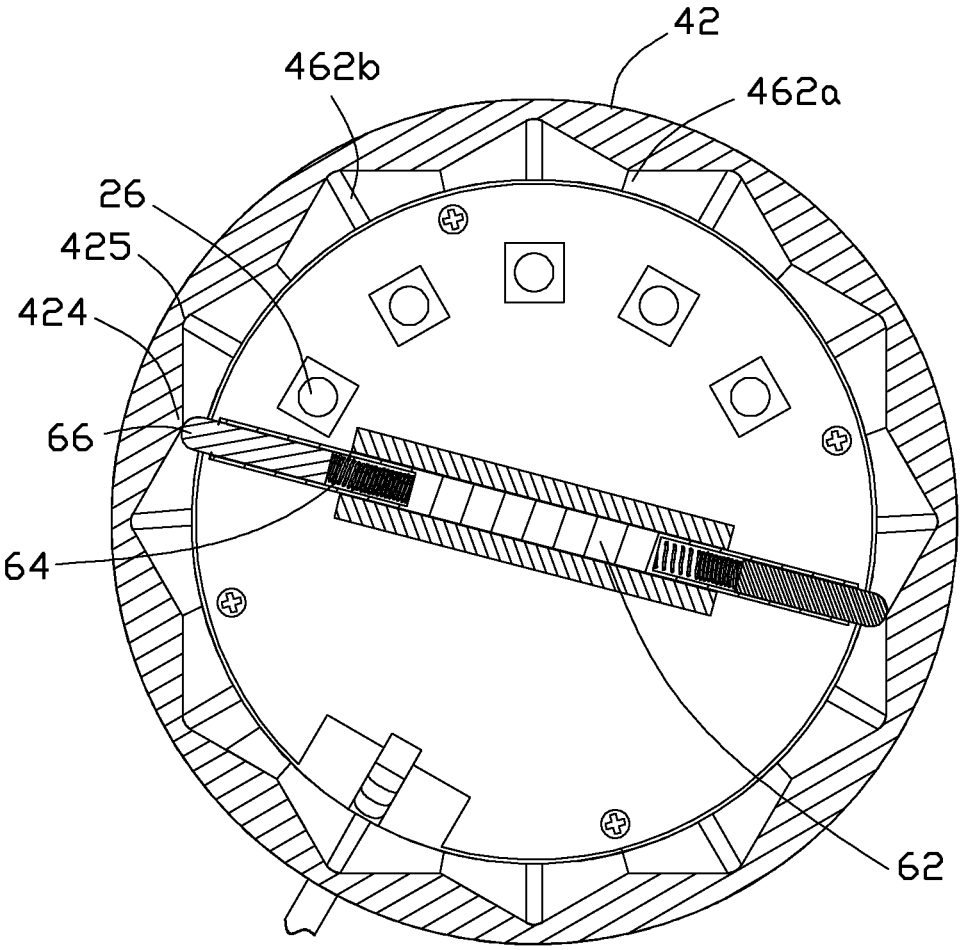
FIGS. 7-8 are similar to FIG. 6, but showing two different states from FIG. 6.
Figure 8:
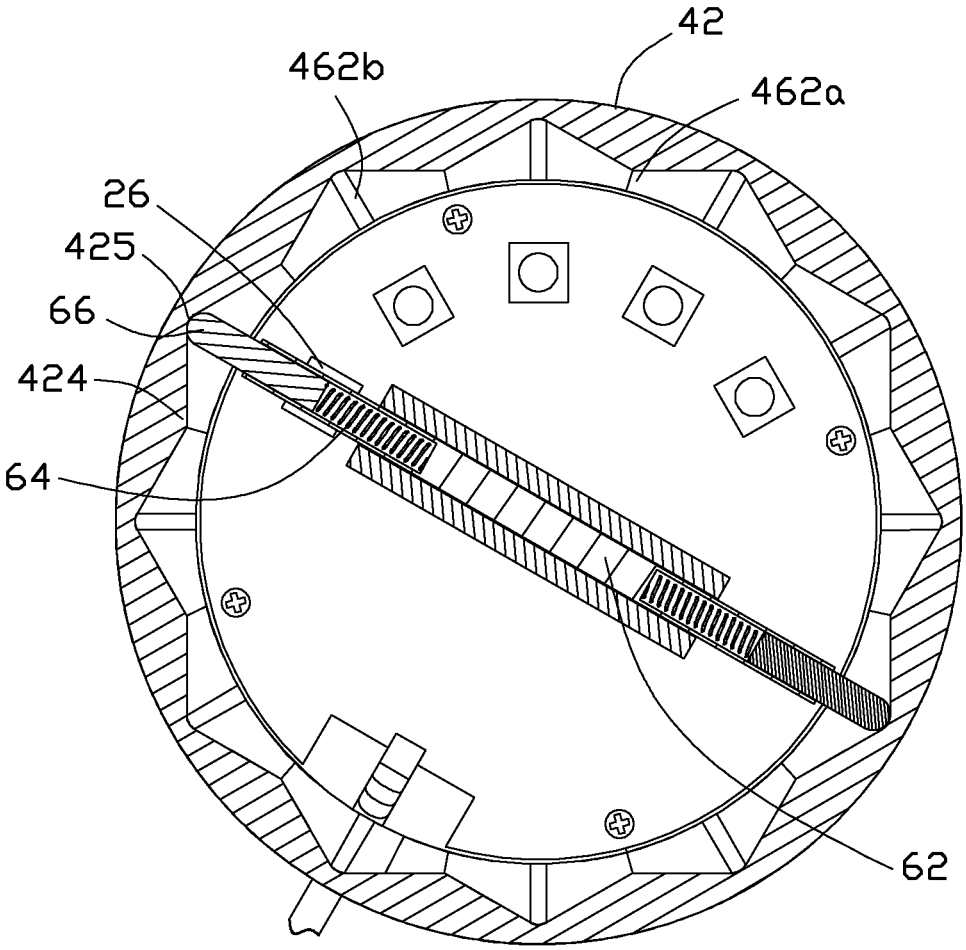

Referring to FIGS. 6-8, in use, the handle 684 of the operation member 68 is rotated by a torsion force. The abutting poles 66 are slid along the guiding slot 48, and the end portions 661 of the abutting poles 66 are slid along the guiding surfaces 426.

The abutting poles 66 are slid from the corresponding indentations 462*b* of the guiding portion 462 toward the corresponding protrusions 462*a*. The end portions 661 of the abutting poles 66 are slid from the corresponding indentations 425 toward the corresponding protrusions 424, deforming the resilient members 64. The rotary pole 62 is slid up along the slot 687, to allow the triggers 624 to move away from the circuit board 24, until the end portions 661 pass over the protrusions 424. The torsion force is removed. The resilient members 64 are restored to bias the end portions 661 to slide into two next indentations 425 of the support member 42. The abutting poles 66 are slid to the next indentations 462*b*. The rotary pole 62 is slid down along the slot 687, to allow the trigger 624 to move down to contact and trigger the corresponding contact 26.

It is to be understood, however, that even though numerous characteristics and advantages of the embodiments have been set forth in the foregoing description, together with details of the structure and function of the embodiments, the present disclosure is illustrative only, and changes may be made in details, especially in matters of shape, size, and arrangement of parts within the principles of the embodiments to the full extent indicated by the broad general meaning of the terms in which the appended claims are expressed.

What is claimed is:

1. A rotary switch, comprising:

a base forming a plurality of contacts arranged in an arc array;

a circular support apparatus installed in the base, and forming a zigzag first guiding portion undulating in a radial direction of the support apparatus, and a zigzag second guiding portion undulating in a direction perpendicular to the radial direction; and a rotary apparatus rotatably installed in the support apparatus, and comprising a rotary pole, a trigger extending down the rotary pole for contacting and triggering a selected one of the contacts, two abutting poles, and two resilient members respectively connected between two opposite ends of the rotary pole and the abutting poles, an end portion of each abutting pole opposite to the rotary pole movably received in the first guiding portion, to allow the abutting pole to stretch or withdraw in the radial direction of the support member, and the end portion of the abutting pole also movably received in the second guiding portion, to allow the rotary pole to undulate in the direction perpendicular to the radial direction, thereby the trigger contacting and triggering the selected contact in response to the abutting poles moving to a bottom of the second guiding portion, and the trigger passing over one of the contacts in response to the abutting poles moving to a top of the second guiding portion.

2. The rotary switch of claim 1, wherein each abutting pole is cylindrical, the end portion of each abutting pole is hemispherical.

3. The rotary switch of claim 1, wherein the support apparatus comprises a support member defining a circular receiving space, the first guiding portion is formed in an inner wall bounding the receiving space.

4. The rotary switch of claim 3, wherein the first guiding portion comprises a plurality of triangular first protrusions and a plurality of first indentations staggered with the first protrusions, the end portions of the abutting poles stretch in response to moving to the first protrusions and withdraw in response to moving to the indentations.

5. The rotary switch of claim 4, wherein each first protrusion comprises two slanted guiding surface connected in a line away from the first indentations.

6. The rotary switch of claim 4, wherein the support apparatus further comprises an annular first position member received in an upper portion of the receiving space, and an annular second position member received in a lower portion of the receiving space and spaced from the first position member, the second guiding portion is formed between the first and second position members.

7. The rotary switch of claim 6, wherein an outer surface of the second position member forms a zigzag fastening portion latched into the first guiding portion of the support member.

8. The rotary switch of claim 6, wherein the second guiding portion is formed on a top of the second position member, and comprises a plurality of triangular second protrusions and a plurality of second indentations staggered with the second protrusions.

9. The rotary switch of claim 8, wherein a third guiding portion is formed on a bottom of the first position member, and comprises a plurality of triangular third protrusions and a plurality of third indentations staggered with the second protrusions, the third guiding portion and the second guiding portion cooperatively bound a zigzag guiding slot.

10. The rotary switch of claim 9, wherein the second protrusions are respectively located at inner sides of the first protrusions, and the second indentations are respectively located at inner sides of the first indentations, the third protrusions are respectively aligned with the second indentations, and the third indentations are respectively aligned with the second protrusions.

11. The rotary switch of claim 9, wherein an outer surface of the first position member defines a zigzag fastening portion latched into the first guiding portion of the support member.

12. The rotary switch of claim 1, wherein the ends of the rotary pole each longitudinally define a locating hole, the resilient members are respectively received in the locating holes, second ends of the abutting poles opposite to the end portions are respectively inserted into the locating holes.

13. The rotary switch of claim 1, wherein the rotary apparatus further comprises an operation member, the operation member comprises a circular rotary plate received in the receiving space of the support member, a handle protruding up from a middle of the rotary plate, and a guiding block extending down from the middle of the rotary plate opposite to the handle, a bottom of the guiding block defines a slot, the rotary pole is slidably received in the slot.

14. The rotary switch of claim 1, wherein each resilient member is a coil spring.

* * * * *